US011486605B2

(12) United States Patent
Modisette, Jr.

(10) Patent No.: US 11,486,605 B2
(45) Date of Patent: Nov. 1, 2022

(54) SYSTEM FOR PRECISION TEMPERATURE CONTROL OF THERMAL BEAD BATHS

(71) Applicant: Air Bath Technologies, LLC, San Antonio, TX (US)

(72) Inventor: James Everett Modisette, Jr., San Antonio, TX (US)

(73) Assignee: James Everett Modisette, Jr., San Antonio, TX (US)

( * ) Notice: Subject to any disclaimer, the term of this patent is extended or adjusted under 35 U.S.C. 154(b) by 0 days.

(21) Appl. No.: 15/668,495

(22) Filed: Aug. 3, 2017

(65) Prior Publication Data

US 2017/0328600 A1 Nov. 16, 2017

Related U.S. Application Data

(62) Division of application No. 13/793,863, filed on Mar. 11, 2013.

(51) Int. Cl.

| | |
|---|---|
| ***H05B 6/10*** | (2006.01) |
| ***H05B 6/06*** | (2006.01) |
| ***F24H 9/20*** | (2022.01) |
| ***F24H 3/04*** | (2022.01) |
| ***F24H 9/00*** | (2022.01) |
| ***B01L 7/00*** | (2006.01) |

(52) U.S. Cl.

CPC ..... *F24H 9/2071* (2013.01); *B01L 7/00* (2013.01); *F24H 3/0405* (2013.01); *F24H 9/0057* (2013.01); *F24H 9/0073* (2013.01); *B01L 2300/18* (2013.01); *B01L 2300/1844* (2013.01); *F24H 2250/02* (2013.01)

(58) Field of Classification Search

CPC ..... B01L 2300/18; B01L 2300/1844; B01L 7/00; F24H 2250/02; F24H 3/0405; F24H 9/0057; F24H 9/0073; F24H 9/2071; F24H 3/04; F24H 9/00; F24H 9/20; G10H 2220/346; G10H 2220/525; G10H 3/14; G10H 3/146

USPC ..... 219/628, 627

See application file for complete search history.

(56) References Cited

U.S. PATENT DOCUMENTS

| | | | |
|---|---|---|---|
| 1,107,834 | A | 8/1914 | Perrin |
| 1,378,474 | A | 5/1921 | Lidberg |
| 2,624,556 | A | 1/1953 | Kistler |
| 3,196,251 | A | 7/1965 | De Bruyne |
| 3,233,659 | A | 2/1966 | Nettel |

(Continued)

*Primary Examiner* — Quang T Van

(74) *Attorney, Agent, or Firm* — Robert L McRae; Gunn, Lee & Cave, P.C.

(57) ABSTRACT

A system for precision temperature control of thermal bead baths used in biological laboratories to heat biological samples. An insulated outer shell and an inner shell sealed together to form a recirculation pathway. The inner shell has an air extraction port opening into the recirculation pathway and at least one air injection port opening into the recirculation pathway. A fan in the recirculation pathway draws air through the air extraction port. A thermal sensor is connected to a control and is disposed in close proximity to one of the air injection ports. Thermal beads are placed in a mesh basket inside the inner shell. The fan draws air from the inner shell through the beads and into the recirculation pathway, where the air is heated by a thermal element. The air flows past the thermal element and through the air injection ports back into the inner shell.

11 Claims, 9 Drawing Sheets

(56) References Cited

U.S. PATENT DOCUMENTS

| | | | | | |
|---|---|---|---|---|---|
| 3,399,874 | A * | 9/1968 | Ritchie | F23G 5/30 | 432/197 |
| 3,466,166 | A | 9/1969 | Levinstein | | |
| 3,637,966 | A | 1/1972 | Moller | | |
| 3,941,355 | A | 3/1976 | Simpson | | |
| 4,054,376 | A | 10/1977 | Wareham | | |
| 4,121,091 | A | 10/1978 | Wareham | | |
| 4,214,576 | A | 7/1980 | Henley | | |
| 4,498,462 | A | 2/1985 | Henley | | |
| 4,657,067 | A | 4/1987 | Rapp | | |
| 4,677,143 | A | 6/1987 | Laurin | | |
| 4,681,738 | A | 6/1987 | Low | | |
| 4,682,992 | A | 7/1987 | Fuchs | | |
| 4,829,158 | A * | 5/1989 | Burnham | F24C 15/325 | 126/21 A |
| 4,896,023 | A | 1/1990 | Uchiyama | | |
| 4,906,466 | A | 3/1990 | Edwards et al. | | |
| 4,935,604 | A * | 6/1990 | Allen | A61L 2/06 | 219/400 |
| 5,086,085 | A | 2/1992 | Pekala | | |
| 5,286,951 | A | 2/1994 | Jones | | |
| 5,396,049 | A | 3/1995 | Knopf | | |
| 5,441,477 | A * | 8/1995 | Hargest | A61H 33/04 | 601/15 |
| 5,529,807 | A | 6/1996 | Burkhart, Jr. | | |
| 6,263,958 | B1 | 7/2001 | Fleishman | | |
| 6,500,394 | B1 | 12/2002 | Fulford | | |
| 6,698,501 | B2 | 3/2004 | Fleischman | | |
| 7,834,299 | B2 * | 11/2010 | Claesson | A21B 1/245 | 126/273 A |
| 2006/0188580 | A1 | 8/2006 | Sacks | | |
| 2009/0233375 | A1 * | 9/2009 | Jarvis | A01N 25/34 | 436/151 |

* cited by examiner

SYSTEM FOR PRECISION TEMPERATURE CONTROL OF THERMAL BEAD BATHS

The present application is a Divisional of U.S. application Ser. No. 13/793,863, filed Mar. 11, 2013.

BACKGROUND OF THE INVENTION

1. Field of the Invention

The present invention relates to thermal baths for heating biological samples in a laboratory. More specifically, the present invention relates to a system and method of precisely controlling the temperature and thermal uniformity of a thermal bead bath to heat, or in some cases cool biological samples more efficiently, precisely and with more temperature uniformity. The present invention provides a thermal airflow system to uniformly maintain the control temperature desired in thermal bead bath.

2. Description of the Related Art

Thermal bead baths have been used by laboratories engaged in biological and/or biomedical research to heat biological samples, and are currently used in such laboratories. In previous embodiments of thermal bead baths, aluminum beads were placed in standard laboratory water bath, and the water bath provided heat to the beads. However, problems have arisen in the use of these bead baths to heat biological samples. Specifically, aluminum beads typically used in such baths are inefficient conductors of heat, and the heating source only supplies heat from the perimeter of the bath. Thus, aluminum bead baths typically suffer from slow warm up times and the inability to achieve thermal uniformity. The heating of the aluminum beads also creates hotspots within the bath, which furthers the problem of thermal discrepancy within the baths. Some have attempted to overcome these challenges by designing baths and control systems specifically for the aluminum beads to eliminate hot spots. However, these baths still experience slow warm up or ramp up times, poor thermal uniformity, poor control and slow response to changes in control temperatures.

The fundamental problem with the thermal bead bath approach is that it is created and operated on the concept of thermal conductivity. Thus, there is a dependency upon thermal conductivity from bath to bead, bead to bead, and then bead to sample. The more the heat is conducted through the elements of the system, temperature variance and heat loss occur. It is therefore desirable to design a system for achieving a desired temperature of a biological sample wherein the temperature throughout the system is controlled with precision and maintained substantially uniformly. It is further desirable for this system to utilize non-liquid, non-fluidized bead baths yielding high thermal efficiency and consistency with suppressed contamination of the beads.

SUMMARY OF THE INVENTION

The present invention overcomes the issues of prior thermal bead baths by providing a recirculating thermal air supply to heat the bulk bead volume contained in the bath. The system transfers thermal energy through the laboratory bead bath and provides improved warm-up speed, thermal uniformity, thermal recovery and overall temperature control. The present invention also is more energy efficient and produces fewer temperature gradients, enabling end-users to thaw reagents or samples more quickly.

The present invention achieves these advantages by supplying heated air to the bulk bead volume, which is the combination of the volume of the beads and the volume of the void space between adjacent beads. Thus, the need for thermal conductivity between adjacent beads is greatly reduced. The present invention provides a closed thermal air recirculation system comprising an insulated outer shell, an inner shell for receiving a mesh basket holding the beads, at least one air injection port, at least one thermal sensor, at least one thermal element, at least one air extraction port, a fan aerodynamically positioned to draw air out of the air extraction port, and a cover. A "fan" of the system of the present invention is meant to encompass, include and mean a fan, a centrifuge blower, an air pump or any other device for circulating air or drawing air.

The outer shell is insulated between its outer wall and the inner air shield. There is an inner shell with its top edge adjacent a top inner edge of the outer shell. The outer shell is generally cylindrically shaped and defines a cavity within the outer shell. The inner shell is disposed within the cavity and is adjacently attached along a top surface to a top surface of the outer shell. The inner shell comprises a side wall and a bottom surface, defining cavity. The inner shell is partially conically shaped. The inner shell recesses in diameter as it extends downward into the cavity of the outer shell such that it is spaced from the inner air shield to define a space between the inner air shield and the inner shell. The space between the inner air shield and the inner shell provides a recirculation pathway for recirculation of air.

The bottom surface of the inner shell comprises an air extraction port. A fan is disposed at an aerodynamic position to draw air through the air extraction port. In one embodiment, the fan is disposed on a bottom surface of the outer shell and in close proximity to the air extraction port, and is oriented in an upward direction. However, the fan may be located anywhere in the system where it can draw air through the air extraction port. In one embodiment, an air filter is provided over the air extraction port to trap bacteria and microbial agents. However, in another embodiment, no air filter is used. The sidewall of the inner shell comprises a plurality of air injection ports which are disposed partially above and partially below a desired fill line of thermal beads. Each air injection port is substantially equally spaced from adjacent air injection ports. Disposed along the inner air shield is a plurality of thermal elements which are connected to a controller (not shown). Any thermal element known in the art of thermal baths may be used.

The thermal elements and the controller are connected to an electrical power distribution block within the outer shell. The thermal elements are connected to the controller and the controller controls operation of the fan and the thermal elements. The fan resides within a diverter plate. The diverter plate comprises a plurality of air distribution ports (not shown) around its periphery. The fan is connected through the diverter plate to a motor within the outer shell which runs the fan. The motor is also connected to the electrical power distribution block, which is connected to a power source (not shown). In another embodiment, the outer shell has an extended periphery, and a recessed cavity within the extended periphery, defining an outer cavity. In this embodiment, the fan is connected to the motor through the bottom of the outer shell. The motor and electrical power distribution block are attached to the outside of the outer shell within the outer cavity. In one embodiment the motor is a variable speed motor that is connected to the controller (not shown) to control the speed of the fan. However, in another embodiment, the motor is a one speed motor operated by the controller.

At least one thermal sensor is disposed within the recirculation pathway in close proximity to one of the air injection ports, and is attached to the inner air shield. In the preferred embodiment, only one thermal sensor is used. However, in an alternative embodiment, more than one of the plurality of air injection ports has a thermal sensor disposed on the inner air shield and extending into the recirculation pathway in close proximity to its corresponding air injection port. In another alternative embodiment, a thermal sensor is placed, alone or in addition to the other one or more thermal sensors, between the fan and the air extraction port. In yet another embodiment, a thermal sensor is placed, alone or in addition to the other one or more thermal sensors within or above the beads in the inner shell. A cover is removably disposed above the outer shell and inner shell and completely covers the inner shell. In one embodiment, a gasket is disposed along the periphery of the cover to engage an indentation along the periphery of the outer shell to form a substantially air-tight engagement between the cover and the outer shell.

In one embodiment, a mesh basket is removably disposed within the inner shell. The mesh basket holds the thermal beads and the biological samples. The thermal beads fill the mesh basket to a desired level. In an alternative embodiment, there is no mesh basket, but rather a wire mesh cover over the injection port. In this embodiment, the thermal beads and biological samples are placed directly in the inner shell to a desired level.

Once the thermal beads are placed in the inner shell, either directly or in the mesh basket, the user secures the cover over the inner shell. A user sets the controller to a desired control temperature, which activates the heating elements to provide heat. The fan is operated by the controller. The fan rotates within the diverter plate and creates a negative atmosphere to draw air out of the bulk bead volume. The air moves through the air distribution ports (not shown) of the diverter plate into the recirculation pathway and upward across the thermal elements to the air injection ports.

Once at the air injection ports, the air is at atmosphere and is injected into the internal shell and through the bulk bead volume where it is drawn back to and through the air extraction port. In the preferred embodiment, the thermal sensor is connected to the controller and sends the temperature information to the controller. In the alternative embodiments where more than one thermal sensor is used, the plurality of thermal sensors, whether along the plurality of injection ports, within the inner shell, or between the fan and the air extraction port, are connected to the controller and each sends its respective temperature information to the controller.

DESCRIPTION OF THE INVENTION

Figure 1:
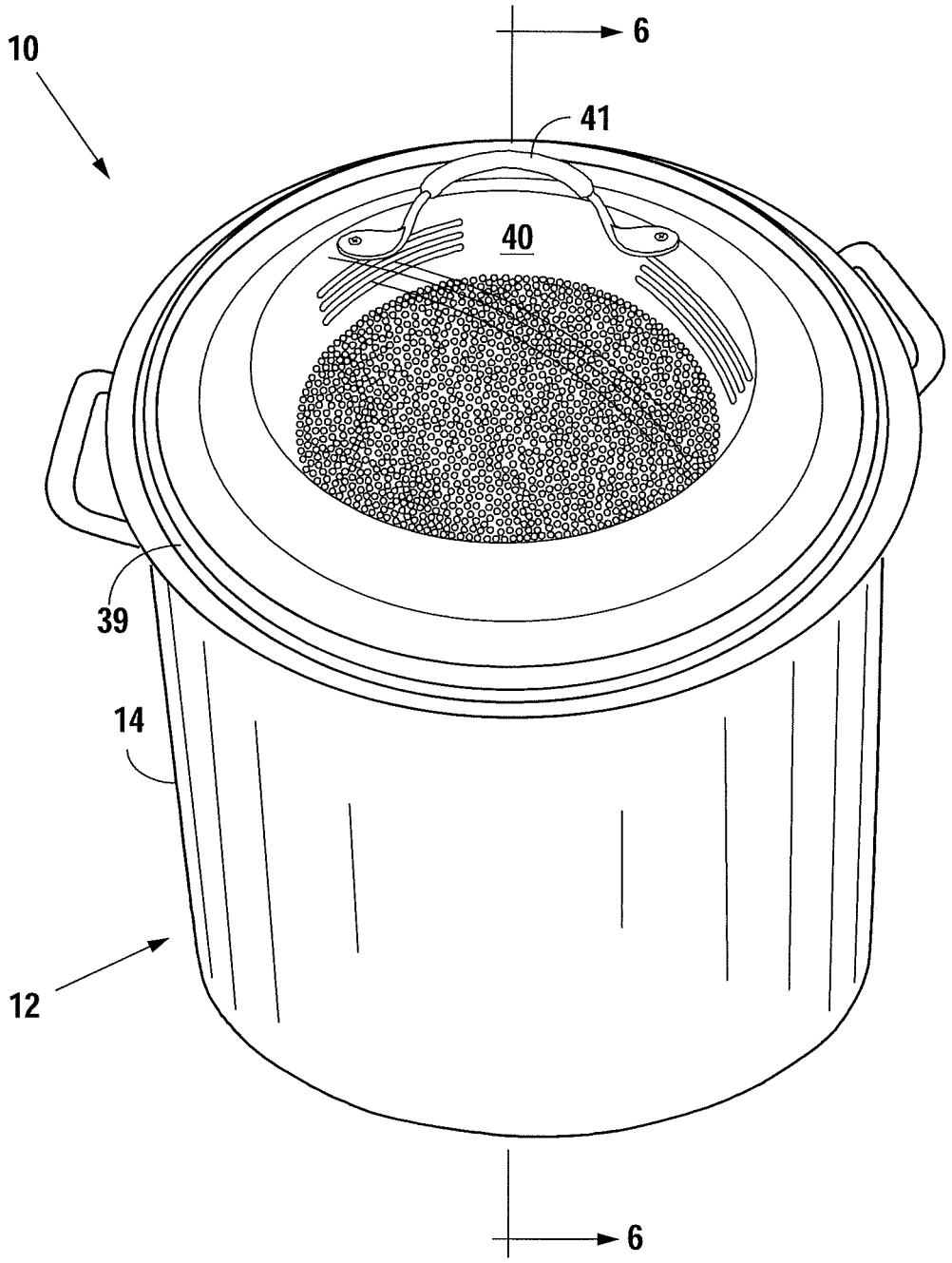
FIG. 1 is a top perspective view of the present invention.
Figure 2:
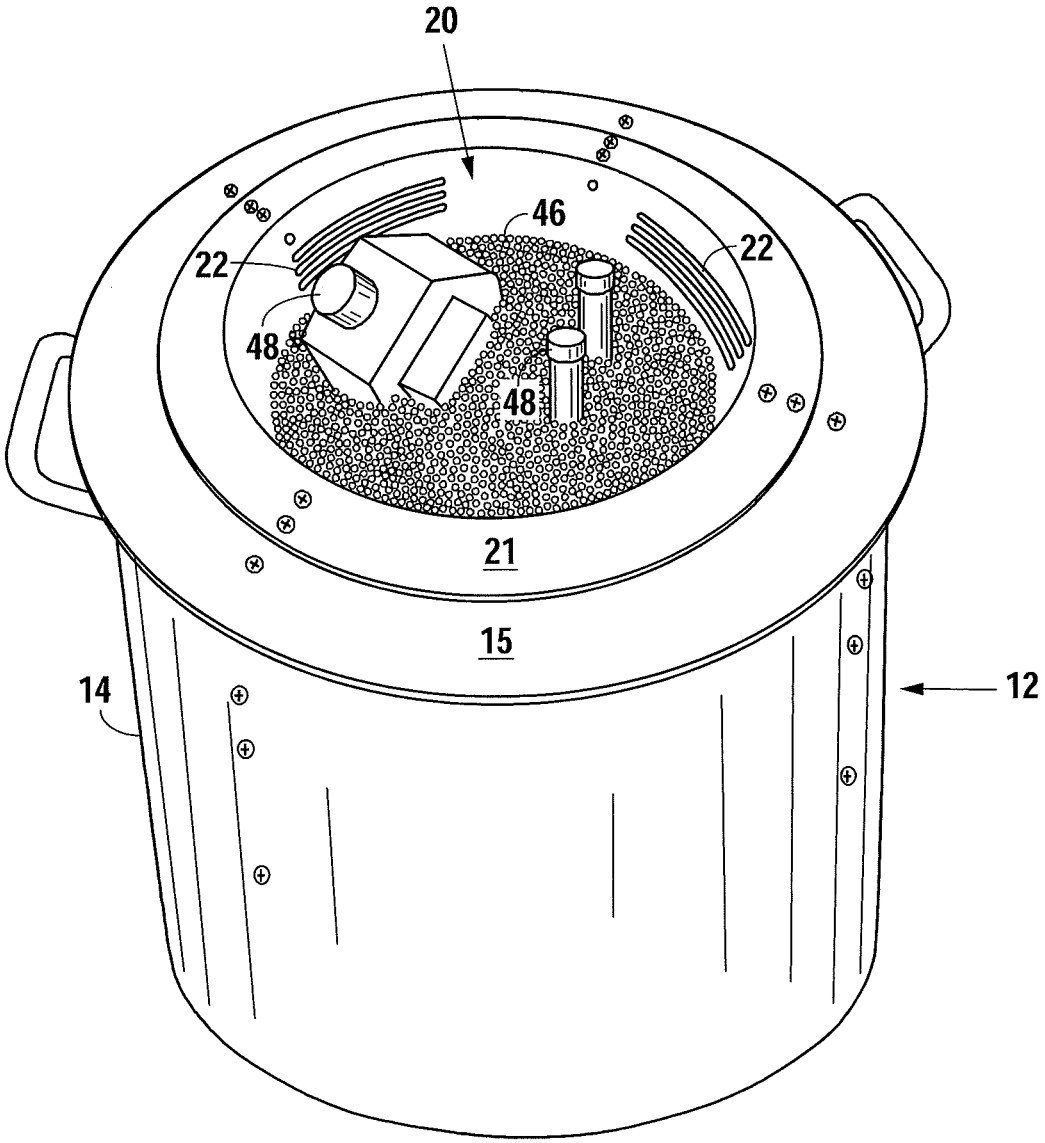
FIG. 2 is a top perspective view of the present invention with thermal beads and biological samples therein.
Figure 3:
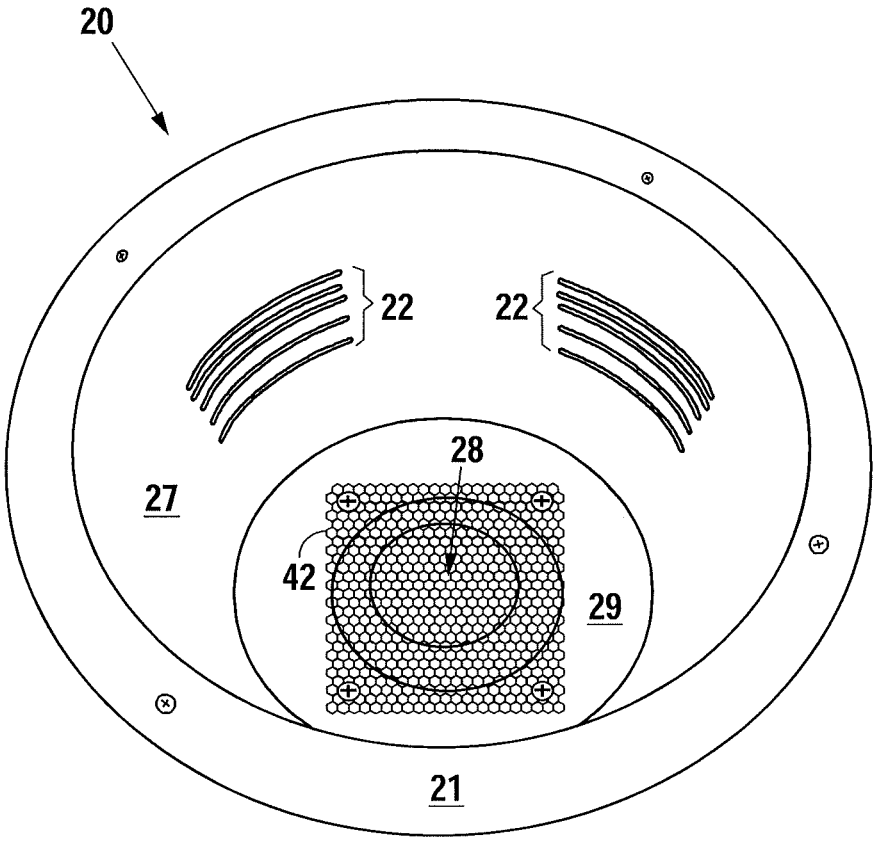
FIG. 3 is a top perspective view of the inner shell of the present invention showing the air extraction port and the air injection ports.
Figure 4:
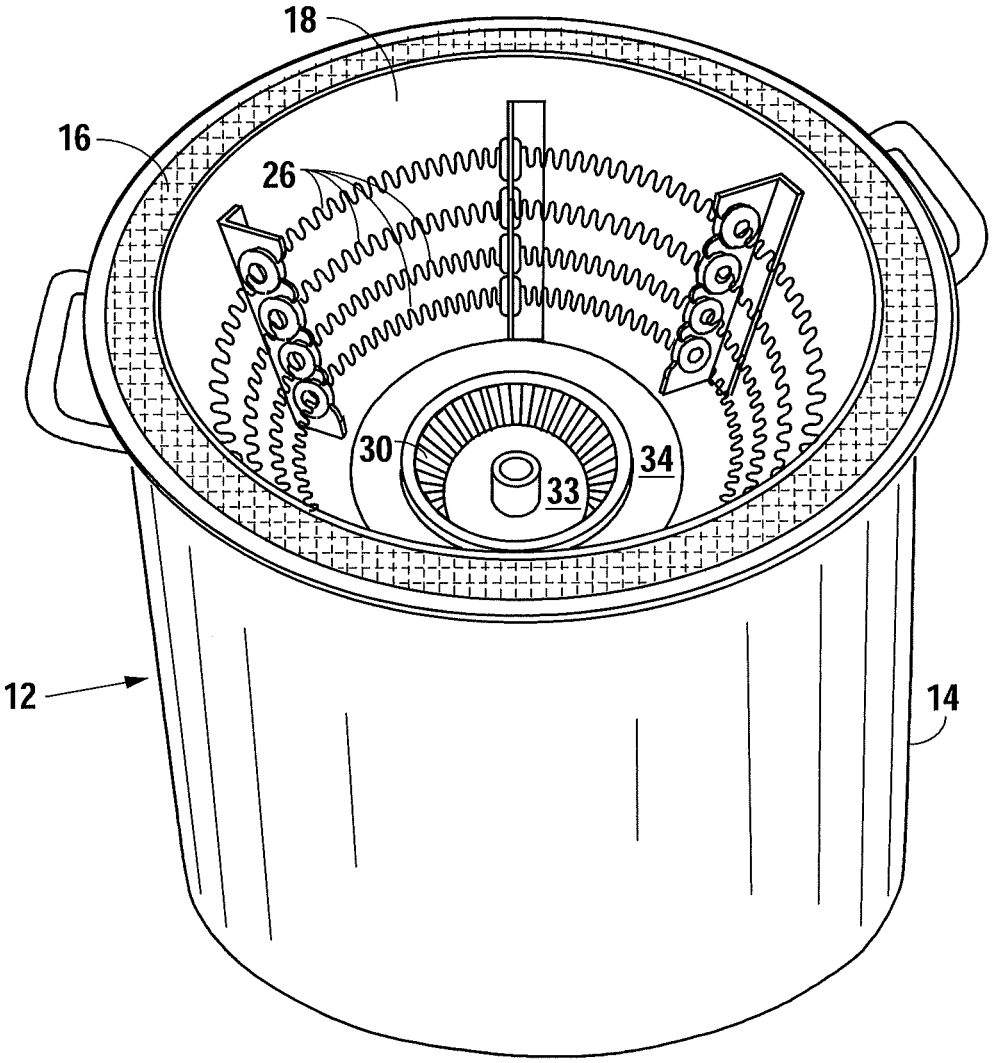
FIG. 4 is a top perspective sectional view of the outer shell of the present invention.
Figure 5:
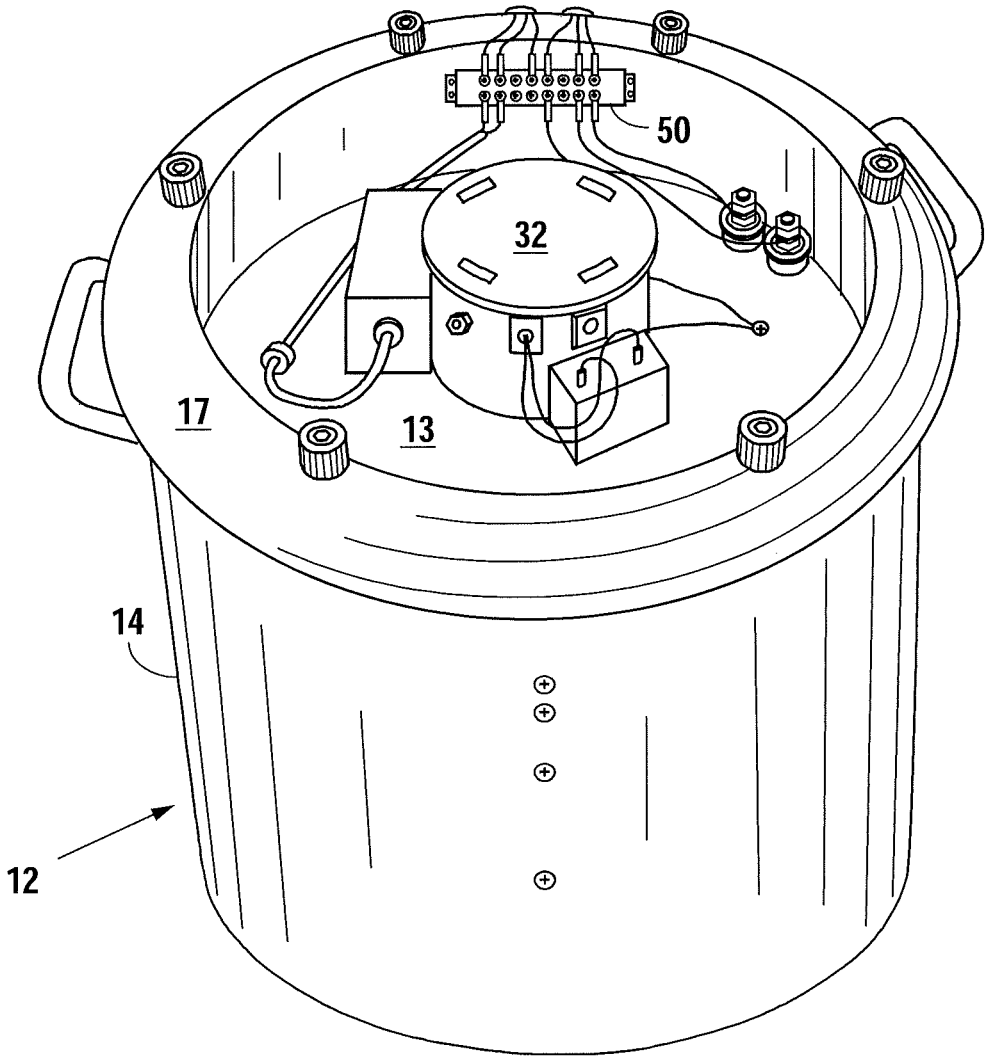
FIG. 5 is a bottom perspective view of the outer shell of the present invention.
Figure 6:
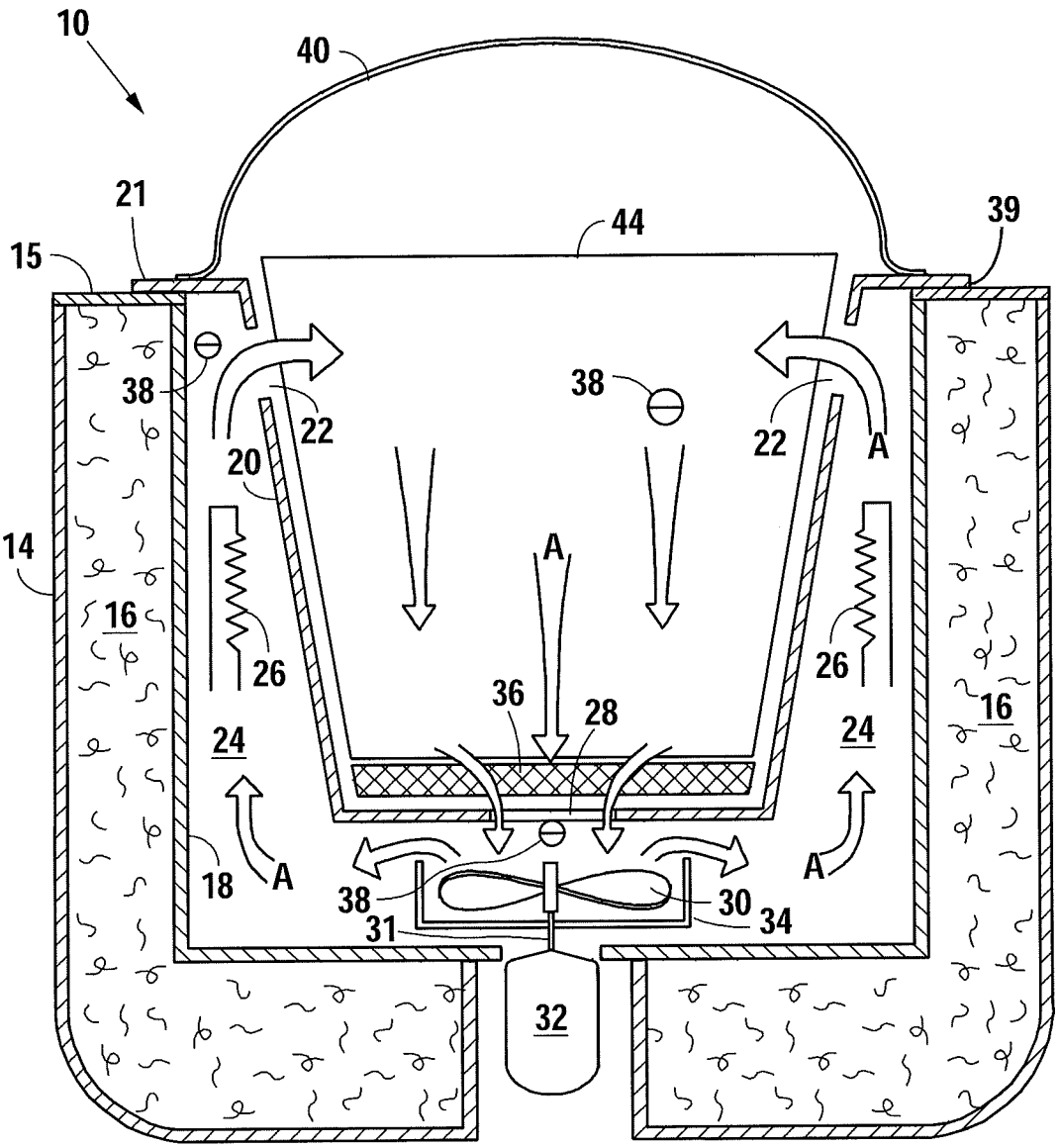
FIG. 6 is a side sectional view of the present invention along section line 6-6 of FIG. 1.

Referring to FIG. 1 through FIG. 9, the preferred embodiment of the present invention 10 is disclosed. Referring to FIG. 1 through FIG. 4, the present invention 10 comprises an outer shell 12 with an outer wall 14. Outer shell 12 is substantially cylindrically shaped and defines within the outer shell 12 a cavity for receiving an inner shell 20. Although described as substantially cylindrically shaped, outer shell 12 can be of any other suitable shape. Referring to FIGS. 1, 4 and 6, outer shell 12 comprises an outer surface 14 and an inner air shield 18 with a layer of insulation 16 between outer surface 14 and inner air shield 18. Insulation 16 reduces heat loss of the system through the outer shell 12. Inner air shield 18 defines an outer wall of a recirculation pathway 24.

Referring to FIG. 2, FIG. 3 and FIG. 6, inner shell 20 comprises a top surface 21, a sidewall 27 adjacent top surface 21, and a bottom 29 adjacent sidewall 27 at the opposite end from top surface 21. Inner shell 20 is substantially conically shaped and rests within outer shell 12 such that the outer surface of sidewall 27 is spaced from inner air shield 18, defining an interior wall of recirculation pathway 24. Although described as conically shaped, inner shell 20 could be of any other suitable shape. Top surface 21 rests on and is secured to a top surface 15 of outer shell 12. In one embodiment, a gasket (not shown) is placed adjacently underneath top surface 21 around sidewall 27, and seals top surface 15 and top surface 21 to seal the top portion of recirculation pathway 24. However, in other embodiments, other seals, glues adhesives or similar sealants may be used to seal recirculation pathway 24 between top surface 15 of outer shell 12 and top surface 21 of inner shell 20. Top surface 15 and top surface 21 are attached to each other using glue, screws, nails, or any other suitable attaching device.

Along an upper portion of sidewall 27, a plurality of air injection ports 22 are disposed through sidewall 27 and extend into recirculation pathway 24. Bottom 29 of inner shell 20 comprises an air extraction port 28 extending through bottom 29 and into recirculation pathway 24. Air extraction port 28 is shown as being substantially circular. However, air extraction port 28 may be of any other shape. In one embodiment of the present invention, a filter 36 may be disposed along bottom 29, extending over air extraction port 28. Filter 36 is an anti-microbial filter to filter bacterial or other microbial agents out of the air as it flows through the system of the present invention 10. In another embodiment a mesh wire overlay 42 is placed over air extraction port 28. In another embodiment of the invention, filter 36 may be placed over mesh wire overlay 42.

Referring to FIG. 4 and FIG. 6, a fan 30 is disposed at an aerodynamic position to draw air through air extraction port 20. Fan comprises a bottom 33. As shown, fan 30 is in close proximity to air extraction port 20 below bottom 29 of inner shell 20. However, fan 30 could be disposed spaced from air extraction port 20, so long as fan 30 can draw air through air extraction port 20. At least one thermal sensor 38 is connected to a controller (not shown) outside of outer shell 12 and sends temperature data of the air moving out of air extraction port 28 to the controller. In the preferred embodiment, a thermal sensor 38 is attached to the inner air shield 18 and extends within recirculation pathway 24 such that a tip (not shown) of the thermal sensor 38 is positioned into the air stream of at least one air injection port 22. However, in other embodiments, multiple air injection ports 22 or all air injection ports 22 may have a thermal sensor 38 in close proximity thereto. In another alternative embodiment, a thermal sensor 38, either alone or in combination with the other at least one thermal sensors 38 may be positioned outside the air extraction port 28, or anywhere else along recirculation pathway 24. In yet another embodiment, a thermal sensor 38 may be disposed within inner shell 20 above or below beads 46. Each thermal sensor 38 of the present invention 10 is connected to the controller and sends temperature data to the controller. The controller displays the temperature data to the user.

Fan 30 is disposed within, and rotates within a diverter plate 34. Diverter plate 34 comprises a plurality of substantially equally spaced air distribution ports (not shown) below fan 30 for distributing air into the recirculation pathway. Fan 30 extends through diverter plate 34 and is connected to motor 32. Motor 32 is connected to an electrical power distribution block 50 which is connected to an electrical source (not shown).

In one embodiment, motor 32 and electrical power distribution block 50 are attached to an interior surface of a bottom 17 of outer shell 12. However, as shown in FIG. 5, in the preferred embodiment, motor 32 and electrical power distribution block 50 are attached to the bottom 17 outside of outer shell 12 within a cavity 13. Bottom 17 has a lowered outer periphery and a raised inner portion to define cavity 13. Motor 32 has a shaft (not shown) extending into outer shell 12 and connecting to fan 30. The shaft and outer shell 12 are sealed together using any suitable known adhesive to maintain an air-tight seal and prevent air leakage during operation. In one embodiment motor 32 is a variable speed motor that is connected to the controller to control the speed of the fan, thereby controlling and varying the velocity of air moving through the system of the present invention 10. However, in another embodiment, motor 32 is a one speed motor operated by the controller.

Referring again to FIG. 2, FIG. 4 and FIG. 6, a plurality of thermal elements 26 are disposed along inner air shield 18 and extend into recirculation pathway 24. Thermal elements 26 are connected to electrical power distribution block 50 and the controller (not shown). Thermal elements 26 heat air flowing through recirculation pathway 24 between air extraction port 28 and air injection ports 22. Referring to FIG. 1, a cover 40 is placed over the top of the present invention 10 to close the system and prevent air and thermal leakage through the top of the present invention. Cover 40 has a gasket (not shown) disposed along the edge of its outer circumference. The gasket engages a lip 39 of top surface 15 of outer shell 12 to form a substantially air-tight connection between cover 40 and outer shell 12, sealing the system of the present invention 10 from the ambient environment. Cover 40 has a handle 41 for removal of cover 40.

Referring to FIG. 6, in the preferred embodiment, a mesh basket 44 holds thermal beads 46 and biological samples 48. Mesh basket 44 provides ease of insertion and removal of beads 46 and samples 48, and prevents beads 46 from entering into air injection ports 22, air extraction port 28, fan 30, diverter plate 34 and recirculation pathway 24. However, as shown in FIG. 3, alternatively, mesh wire overlay 42 may be attached to bottom 29 of inner shell 20 to prevent beads 46 from entering into air extraction port 28, fan 30, diverter plate 34 and recirculation pathway 24.

Figure 9:
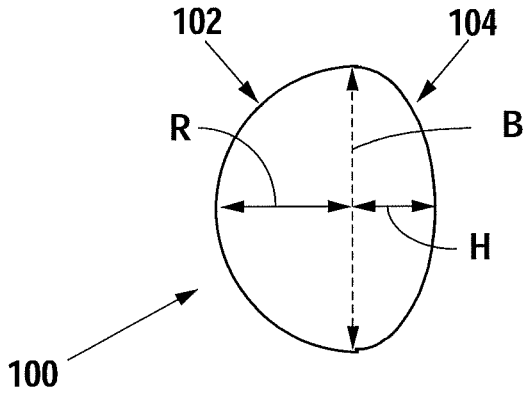
FIG. 9 shows a side view of a bead design of the present invention.

Although the present invention 10 can work well with any thermally conductive or thermally non-conductive beads in the art, referring to FIG. 9, a design for beads 100 to be used in the system of the present invention 10 is disclosed. The beads 100 of the present invention 10 are substantially aspherically shaped, having two spherical surfaces. A first spherical cap is hemisphere 102, which is adjacent a second spherical cap 104. Hemisphere 102 and spherical cap 104 are of unequal or different radii and join along their respective bases to form a base diameter B. Hemisphere 102 has a radius R extending from its apex to base diameter B. Spherical cap 104 has a cap height H extending from base diameter B to its apex. In one embodiment, cap height H is approximately one half radius R. However, cap height H may be greater than or less than one half radius R in other embodiments.

This design of beads 100 provides optimal void space between adjacent beads 100 to moderate airflow restriction, and eases insertion of containers of various shapes and sizes containing samples 50. As force is applied during sample insertion into the system of the present invention 10, the aspherical design of beads 100 allows the beads 100 to rotate in place, thus reducing the linear dimension of the beads 100 along the axis of the force (not shown). This rotation results in an increase of localized bead bed density and less bead 100 movement, which reduces the insertion force into the system of the present invention 10. In one embodiment, beads 100 are made of a polymer such as polypropylene, and are minimally thermally conductive. However, in other embodiments, beads 100 may be made of any suitable thermally conductive material out of which other thermally conductive beads are made.

Referring to FIG. 2 and FIG. 6, thermal beads 46 and samples 48 are placed within mesh basket 44 and mesh basket 44 is placed within inner shell 20. In one embodiment, beads 46 should be at a level within mesh basket 44 partially above and partially below air injection ports 22 when mesh basket 44 is placed within inner shell 20. Similarly, in the alternative embodiment, if the beads 46 are placed directly in inner shell 20, beads 46 should be at a level partially above and partially below air injection ports 22. However, alternatively, beads 46 could be at a level completely below or completely above air injection ports 22. In operation, the user adjusts the controller to a desired control temperature and activates thermal elements 26 and fan 30 by a control switch (not shown) on the controller. In one embodiment, thermal elements 26 and fan 30 are activated by a single control switch (not shown). Alternatively, thermal elements 26 and fan 30 may be controlled by separate control switches (not shown).

Fan 30 is oriented within recirculation pathway 24 and diverter plate 34 such that air is drawn out of inner shell 20, as indicated by airflow directional arrows A in FIG. 6. Upon activation of the system of the present invention, fan 30 draws air out of inner shell 18, from the bulk bead volume within mesh basket 44. The air flows out of air extraction port 28 across thermal sensor 38 and through air distribution ports into recirculation pathway 24. As the air travels through recirculation pathway 24, it is heated to the control temperature as it crosses thermal elements 26. The heated air then flows across at least one thermal sensor 38 in close proximity to air injection ports 22, and then through air injection ports 22 into the bulk bead volume where it is drawn back through air extraction port 28.

As shown and described, airflow A through the bulk bead volume is vertical from top to bottom through inner shell 20. However, it should be understood that other airflow patterns may be used depending on the size and/or shape of the system of the present invention 10. Other airflow configurations include, but are not limited to vertical bottom to top, laterally side to side, radial, or any combination thereof. Moreover, the system of the present invention can operate with thermally non-conductive beads or thermally conductive beads effectively, due to the fact that the system of the present invention 10 is heated by heating recirculating air instead of requiring the walls to provide heat to the system, which require heat transfer through the medium, as is done with all other baths of the prior art.

The system of the present invention 10 is further illustrated by the following Examples, which should not be construed in a limiting sense.

Example 1: Performance Comparison

The system of the present invention 10 was compared against a standard, universally accepted laboratory water bath (not shown), and a standard bead bath using thermally conductive aluminum beads (not shown). Two variations of the system of the present invention 10 were tested. First, a system of the present invention 10 wherein thermally conductive aluminum beads (not shown) was tested. Second, a system of the present invention 10 wherein thermally non-conductive polymer beads (not shown) was tested. "Thermally non-conductive polymer beads" means, for purposes of this disclosure, beads having a thermal conductivity value low enough so as not to be a significant contributor to the thermal conductivity of the system of the present invention 10. All baths were tested with each bath's respective factory installed digital controllers with 0.1° C. digital readouts. All samples were tested with digital controllers with 0.1° C. digital readouts, and connected to 0.1° C. thermal digital probes. The following Table 1 shows the results of the tests of the four baths:

TABLE 1

| | VOLUME | | | |
|---|---|---|---|---|
| BATH TYPE | Bath Only | 10 ML | 50 ML | 500 ML |
| Water Bath | 36 | 6 | 14 | 31 |
| Thermal Air Recirculation - Aluminum | 12 | 9 | 26 | 45 |
| Thermal Air Recirculation - Polymer | 5 | 7.5 | 20 | 58 |
| Bead Bath - Aluminum | 90 | 16 | 48 | 168 |

Temperatures were monitored, and the amount of time in minutes to achieve a control temperature were recorded in Table 1. First, the amount of time in minutes was recorded for the bath type to achieve 38° C. was recorded. Recording of time was taken from room temperature of each bath type to 38° C. Standard water bath achieved 38° C. in thirty six minutes. The system of the present invention 10 using thermally conductive aluminum beads ("Thermal Air Recirculation—Aluminum" in Table 1) achieved 38° C. in twelve minutes. The system of the present invention 10 using thermally non-conductive polymer beads ("Thermal Air Recirculation—Polymer" in Table 1) achieved 38° C. in five minutes. Standard aluminum bead bath achieved 38° C. in ninety minutes.

Next, volumes of samples were inserted into containers and into each bath type. Distilled water was used as the sample. Containers for the 10 ml and 50 ml samples were conical test tubes, and the container for the 500 ml sample was a standard laboratory bottle. Distilled water in the amounts indicated in Table 1 were inserted into the containers at a temperature of 7° C., and the time in minutes taken by each bath type for the sample to achieve 35° C. was recorded. The results are found in Table 1 for each bath type and each sample. Both the Thermal Air Recirculation—Aluminum and Thermal Air Recirculation—Polymer achieved the desired temperatures of the samples substantially quicker than the standard aluminum bead bath.

Next, volumes of samples were inserted into containers and frozen to −20° C. Distilled water was used as the sample. Containers for the 10 ml and 50 ml samples were conical test tubes, and the container for the 500 ml sample was a standard laboratory bottle. Distilled water in the amounts indicated in Table 1 were inserted into the containers and frozen to at a temperature of −20° C., and the time in minutes taken by each bath type for the sample to achieve 35° C. was recorded. The results are found in Table 2 herein below for each bath type and each sample. Both the Thermal Air Recirculation—Aluminum and Thermal Air Recirculation—Polymer achieved the desired temperatures of the samples substantially quicker than the standard aluminum bead bath.

TABLE 2

| | VOLUME | | |
|---|---|---|---|
| BATH TYPE | 10 ML | 50 ML | 500 ML |
| Water Bath | 10 | 24 | 58 |
| Thermal Air Recirculation - Aluminum | 15 | 40 | 122 |
| Thermal Air Recirculation - Polymer | 15 | 41 | 139 |
| Bead Bath - Aluminum | 39 | 109 | 373 |

Example 2: Thermal Uniformity of Standard Bead Bath

In this example, a standard rectangular bead bath (not shown) was filled with aluminum beads (not shown). A digital controller with 0.1° C. digital readouts was connected to four 0.1° C. thermal digital probes. Two of the probes were inserted in diagonally opposite corners of the bath from one another; with one being closest to the temperature sensor, and both being inserted one half the depth of the aluminum bead media depth. A third thermal probe was inserted in the center of the aluminum bead media, approximately one inch from the top thereof. A fourth thermal probe was inserted in the center of the media approximately one inch from the bottom of the bath.

Figure 7:
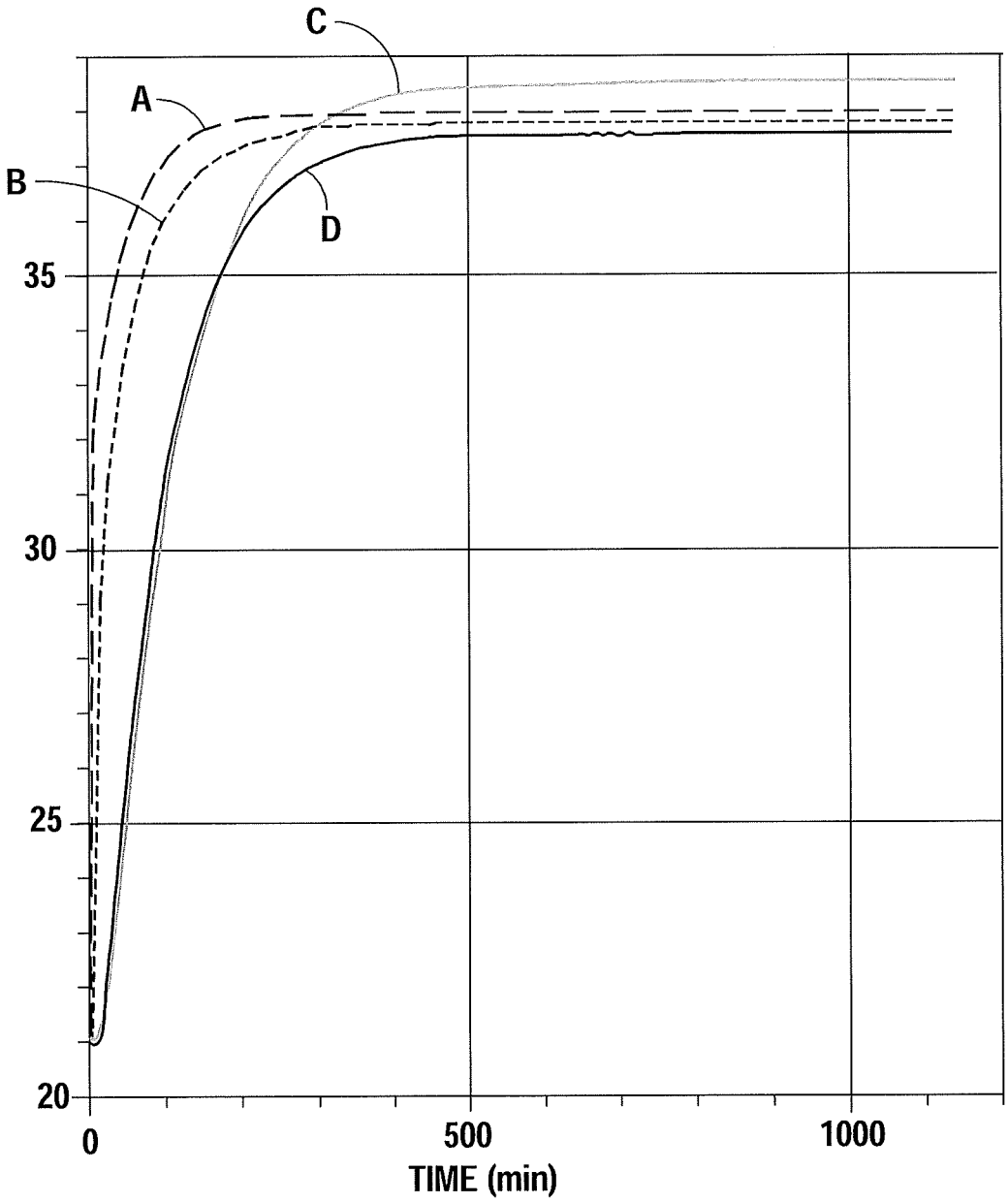
FIG. 7 is a graph showing thermal non-uniformity of prior art aluminum bead baths.

Temperatures were measured and recorded for each thermal probe in one minute increments for over one thousand minutes. FIG. 7 shows the results of the thermal uniformity of the four probes wherein graph line A represents the probe closes to the controller, graph line B represents the probe furthest from the controller, graph line C represents the center probe one inch from the top of the aluminum bead media, and graph line D represents the center probe one inch from the bottom of the bottom. The data exhibited thermal non-uniformity between the probes of several degrees during ramp up to control temperature. In fact, temperatures of the probes varied by more than ten degrees at times during ramp up to control temperature. The data also exhibited an amount of time to reach useful thermal uniformity after reaching control temperature of over six hours.

Example 3: Thermal Uniformity of the System of the Present Invention

In this example, a system of the present invention 10 was tested to determine thermal uniformity at different locations within the polymer bead media. A digital controller with 0.1° C. digital readouts was connected to six 0.1° C. thermal digital probes (not shown). Three of the probes were placed along the center vertical axis of the bead media: a first probe one inch from the top of the bead media, a second probe one inch from the bottom of the bead media, and a third probe substantially equally distant between the first and second probes. A fourth probe and a fifth probe opposed one another on lateral sides of the bead media and approximately half way down in depth. A sixth probe was disposed above the bead media near an air injection port 22.

Figure 8:
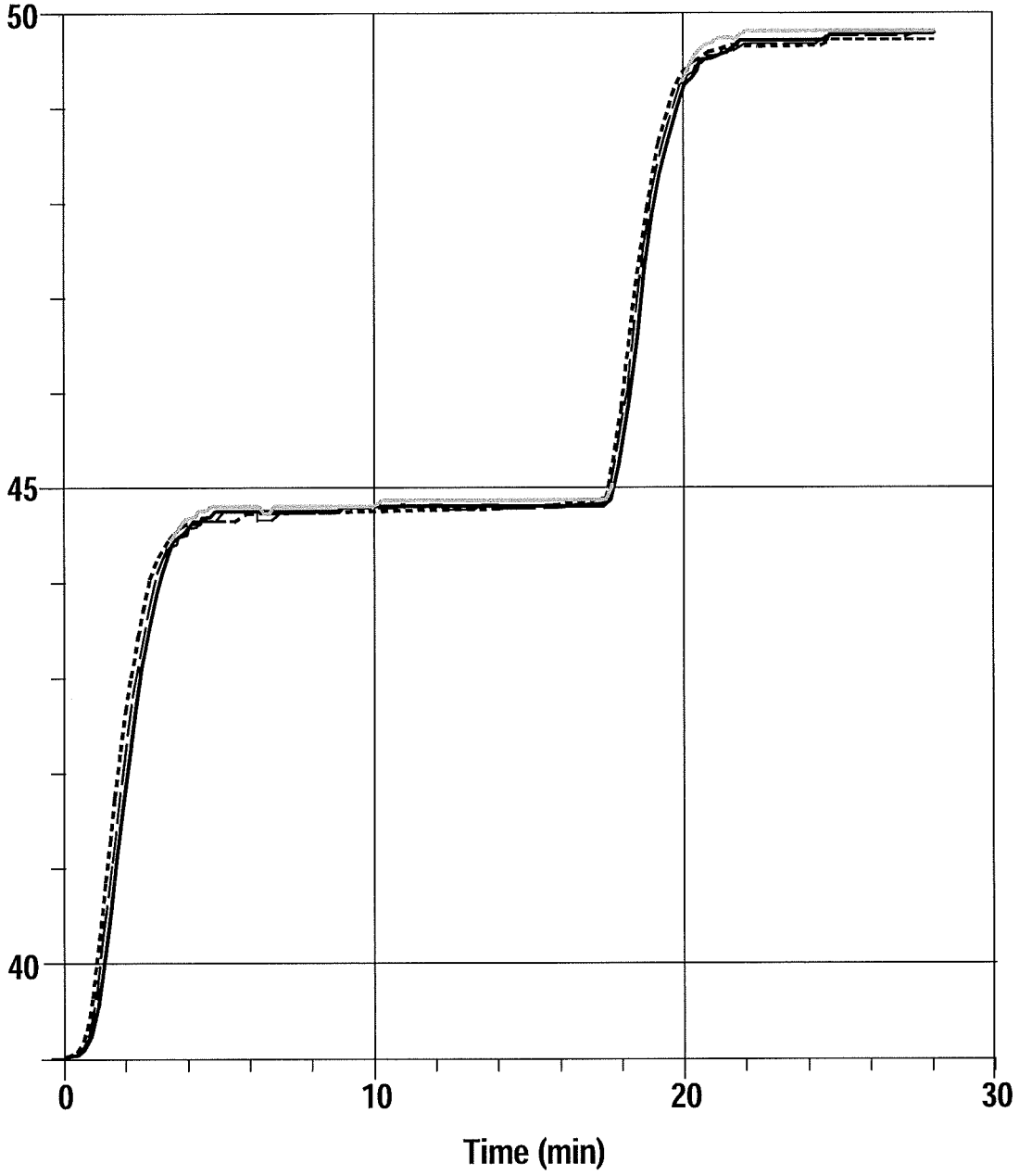
FIG. 8 is a graph showing thermal uniformity of the present invention.

Temperatures were measured and recorded for each thermal probe in six second, or 1/10 of a minute increments. FIG. 8 shows the results of the thermal uniformity of the present invention during a two-step ramp up to two different control temperatures. The system of the present invention was first ramped up to a control temperature of 45° C. Substantial thermal uniformity was observed during the first ramp-up. Thermal variance during the first ramp up was observed to be no greater than a few tenths of a degree. During plateau at 45° C., the time to reach useful stability was observed well under ten minutes from ramp up, and variance was generally observed to be no more than one tenth of a degree.

Second ramp up of the system of the present invention was from 45° C. to 50° C. Again, substantial thermal uniformity was observed, with thermal variance being observed to be no greater than a few tenths of a degree. During plateau at 50° C., the time to reach useful stability was observed well under ten minutes from ramp up, and variance was generally observed to be no more than one tenth of a degree.

Although the invention has been described with reference to specific embodiments and working Examples herein, this description is not meant to be construed in a limited sense. Various modifications of the disclosed embodiments and Examples, as well as alternative embodiments of the invention will become apparent to persons skilled in the art upon the reference to the description of the invention and the Examples. Such embodiments include, but are not limited to embodiments of the system of the present invention 10 wherein the outer shell 12 and inner shell 20 are of different shapes and configurations, including but not limited to rectangular embodiments. Moreover, thermally conductive beads, thermally non-conductive polymer beads, or other known alternatives to aluminum thermally conductive beads may be used as the medium within mesh basket 44. It is therefore contemplated that the appended claims will cover such modifications that fall within the scope of the invention.

I claim:

1. A system for reaching and maintaining a desired temperature in a biological sample stored in a container comprising:

an outer shell comprising an outer layer, an inner air shield opposite said outer layer, a top surface disposed along a top edge of said outer layer and said inner air shield, and a bottom surface, said outer shell defining a cavity;

an inner shell comprising a bottom and a sidewall adjacent said bottom, at least one air extraction port along said bottom and at least one air injection port along an upper portion of said sidewall and spaced from said air extraction port, and a top surface, wherein said top surface of said inner shell and said top surface of said outer shell are sealed, and wherein said sidewall is spaced from said inner air shield to define a recirculation pathway;

a fan disposed in a position to draw air through said air extraction port to said recirculation pathway, said fan being connected to a motor, and said motor being connected to a power source and a controller;

at least one thermal element disposed within said recirculation pathway and connected to said power source and said controller;

at least one thermal sensor disposed within said recirculation pathway and connected to said controller;

a plurality of non-fluidized and non-liquid beads, each of said plurality of beads comprising a first spherical cap adjacent a second spherical cap at a common base, said common base defining a base diameter, said second spherical cap having a radius extending perpendicularly from a center point of said base diameter to an apex of said second spherical cap and said first spherical cap having a radius extending perpendicularly from said center point of said base diameter radius to an apex of said first spherical cap, wherein said radius of said first spherical cap is different from said radius of said second spherical cap, said plurality of beads facilitating airflow from said at least one air injection port downward through said plurality of beads and through said air extraction port; said plurality of beads being shaped to rotate with respect to adjacent beads when a sample is inserted into said system to reduce linear dimensions of said beads along a force axis as said sample is inserted to ease insertion of said sample;

a cover disposed over said inner shell and forming a substantially air tight connection with said top surface of said outer shell; and wherein said fan draws air from said at least one air extraction port into said recirculation pathway, and said thermal element heats said air passing through said recirculation pathway to said at least one air injection port.

2. The system for reaching and maintaining a desired temperature in a biological sample as recited in claim 1 wherein said plurality of beads is selected from the group consisting of a plurality of thermally conductive beads or a plurality of thermally non-conductive beads.

3. The system for reaching and maintaining a desired temperature in a biological sample as recited in claim 1 wherein said at least one thermal sensor is disposed within an airflow pathway of said at least one air injection port.

4. The system for reaching and maintaining a desired temperature in a biological sample as recited in claim 3 comprising a thermal sensor is disposed within an airflow pathway of said at least one air extraction port.

5. The system for reaching and maintaining a desired temperature in a biological sample as recited in claim 3 comprising a thermal sensor is disposed within said inner shell.

6. The system for reaching and maintaining a desired temperature in a biological sample as recited in claim 3 further comprising a diverter plate for receiving said fan, said diverter plate being disposed between said fan and said motor, and comprising a plurality of air distribution ports.

7. The system for reaching and maintaining a desired temperature in a biological sample as recited in claim 1 wherein said at least one thermal sensor is disposed within an airflow pathway of said at least one air extraction port.

8. The system for reaching and maintaining a desired temperature in a biological sample as recited in claim 1 wherein said at least one thermal sensor is disposed within said inner shell.

9. The system for reaching and maintaining a desired temperature in a biological sample as recited in claim 1 further comprising a layer of insulation disposed between said inner air shield and said outer layer of said outer shell.

10. The system for reaching and maintaining a desired temperature in a biological sample as recited in claim 1 further comprising:

a substantially permeable receptacle for receiving said plurality of beads, said receptacle being removably disposed within said inner shell.

11. The system for reaching and maintaining a desired temperature in a biological sample as recited in claim 1 wherein said fan is disposed within said recirculation pathway in close proximity to said air extraction port.

* * * * *